US010077735B2

(12) United States Patent
Ardezzone

(10) Patent No.: US 10,077,735 B2
(45) Date of Patent: Sep. 18, 2018

(54) CAPTURED ENGINE CYLINDER SLEEVE AND COATING

(71) Applicant: Frank J. Ardezzone, Santa Clara, CA (US)

(72) Inventor: Frank J. Ardezzone, Santa Clara, CA (US)

( * ) Notice: Subject to any disclaimer, the term of this patent is extended or adjusted under 35 U.S.C. 154(b) by 0 days.

(21) Appl. No.: 15/257,867

(22) Filed: Sep. 6, 2016

(65) Prior Publication Data

US 2016/0377021 A1 Dec. 29, 2016

Related U.S. Application Data

(63) Continuation-in-part of application No. 15/150,390, filed on May 9, 2016.

(60) Provisional application No. 62/158,487, filed on May 7, 2015, provisional application No. 62/214,201, filed on Sep. 4, 2015, provisional application No. 62/214,203, filed on Sep. 4, 2015.

(51) Int. Cl.

| | |
|---|---|
| ***F02B 77/02*** | (2006.01) |
| ***F02F 1/00*** | (2006.01) |
| ***F02F 7/00*** | (2006.01) |
| *F02B 1/04* | (2006.01) |
| *F02B 3/06* | (2006.01) |
| *F02B 77/11* | (2006.01) |

(52) U.S. Cl.

CPC ..... *F02F 1/004* (2013.01); *F02F 7/00* (2013.01); *F02F 7/0046* (2013.01); *F02B 1/04* (2013.01); *F02B 3/06* (2013.01); *F02B 77/02* (2013.01); *F02B 77/11* (2013.01); *F02F 2200/00* (2013.01); *F05C 2201/021* (2013.01); *F05C 2251/046* (2013.01)

(58) Field of Classification Search

CPC .... F02B 77/02; F02B 3/06; F02B 1/04; F02B 77/11; F05C 2201/021; F05C 2251/046

USPC ..... 123/669, 668

See application file for complete search history.

(56) References Cited

U.S. PATENT DOCUMENTS

2005/0161014 A1* 7/2005 Komai ..... B22D 19/0009 123/193.2
2005/0257756 A1* 11/2005 Endoh ..... F01P 3/02 123/41.79
2006/0219192 A1* 10/2006 Rasmussen ..... F02F 1/004 123/41.84

* cited by examiner

*Primary Examiner* — Jacob Amick
*Assistant Examiner* — Charles Brauch
(74) *Attorney, Agent, or Firm* — Law Office of Craig Bohn; Craig E. Bohn

(57) ABSTRACT

A cylinder sleeve having an appendage that projects downwardly into the engine block coaxial with the sleeve face, but positioned distal from the sleeve face, such that a finger of engine material exists between the sleeve appendage and the sleeve perimeter, and an extreme wear coating formable on the sleeve face.

7 Claims, 4 Drawing Sheets

CAPTURED ENGINE CYLINDER SLEEVE AND COATING

CROSS-REFERENCE TO RELATED APPLICATIONS

This application claims the benefit of U.S. Application No. 62/214,201, filed on Sep. 4, 2015, by the present inventor, entitled "Engine Cylinder Sleeve and Process for Installing," U.S. Application No. 62/214,203, filed on Sep. 4, 2015, by the present inventor, entitled "Coated Cylinder Wall and Process for Making," and U.S. application Ser. No. 15/150,390, filed on May 9, 2016, by the present inventor, entitled "Engine Insert and Process for Installing," which claims priority to U.S. Application No. 62/158,487, filed on May 7, 2015, by the present inventor, entitled "Engine Insert and Process for Installing," which are all hereby incorporated by reference in their entirety for all allowable purposes, including the incorporation and preservation of any and all rights to patentable subject matter of the inventor, such as features, elements, processes and process steps, and improvements that may supplement or relate to the subject matter described herein.

STATEMENT REGARDING FEDERALLY SPONSORED RESEARCH OR DEVELOPMENT

Not Applicable

BACKGROUND OF THE INVENTION

This invention relates generally to internal combustion engine cylinder sleeves, and more specifically to an extreme wear-resistant cylinder sleeve, creation and installation process that establishes secure sleeve installation in an engine block where the engine block and sleeve are comprised of materials with dissimilar coefficients of expansion.

The field of manufacturing internal combustion engines has slowly developed over the past two centuries. Today, various materials are used in the engines and the engine components in an attempt to reduce weight, dissipate heat, and increase durability and reliability. With varied materials come varied physical properties, some which are desired, such as durability and heat dissipation, and some that are not desirable, such as differing thermal expansion. In particular, differing coefficients of thermal expansion between the engine block material and components inserted into the blocks have been a problem to the field for a long time.

If the engine block in which the cylinder sleeve is installed and the sleeve have differing coefficients of expansion, when the engine gets hot they expand at a different rate than the sleeve. Additionally, when the engine and sleeve get extremely cold they contract, and then when the engine is started, the parts heat and expand at different rates. In either scenario sleeves may become loose and interfere with the function of the pistons, causing severe damage.

It would be an improvement to the field of art to have the cylinder sleeve and engine block design where the interference fit between the engine block and the sleeve does not greatly diminish with extreme temperatures and the rapid change in temperatures. It would additionally be an improvement to the field of art to have an extreme wear resistant cylinder sleeve wall formed integral to either or both the cylinder wall and cylinder sleeve wall.

SUMMARY OF THE INVENTION

The present development is a cylinder sleeve having an appendage that projects downwardly into the engine block coaxial with the sleeve face, but positioned distal from the sleeve face, such that a finger of engine material exists between the sleeve appendage and the sleeve perimeter. An extended wear surface formed integral to the sleeve wall. The present design and process will result in increased retention impingement between the cylinder sleeve appendage and the finger of engine material, which offsets other diminished impingement areas between the appendaged sleeve and the engine block. This applies to various engine and sleeve combinations of dissimilar materials over a large temperature range. The appendaged sleeve permits a process of securely press-fitting of the sleeve into the engine at ambient temperatures and an extreme wear surface integral to the secure sleeve.

DESCRIPTION OF THE PREFERRED EMBODIMENT

Figure 1:
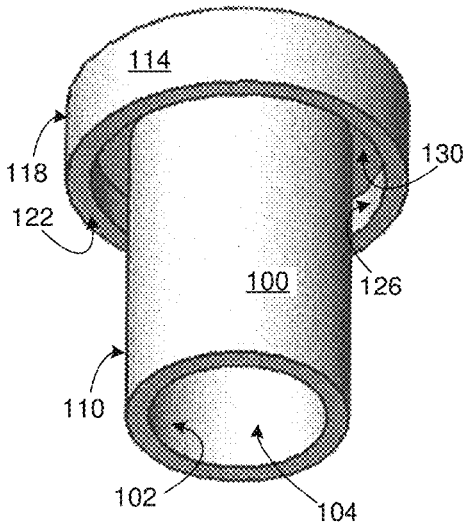
FIG. 1 is a perspective view of an exemplary captured sleeve according to the present invention.
Figure 2:
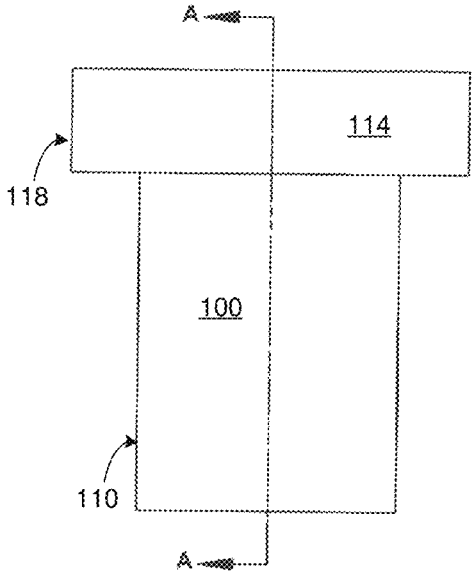
FIG. 2 is a schematic side view of the captured cylinder sleeve of FIG. 1.
Figure 3:
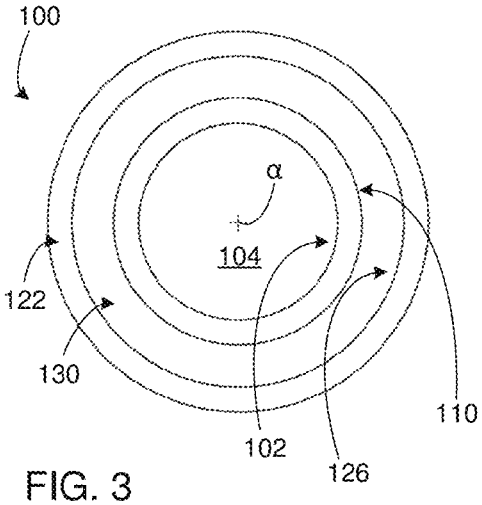
FIG. 3 is a bottom view of the captured cylinder sleeve of FIG. 1.
Figure 4:
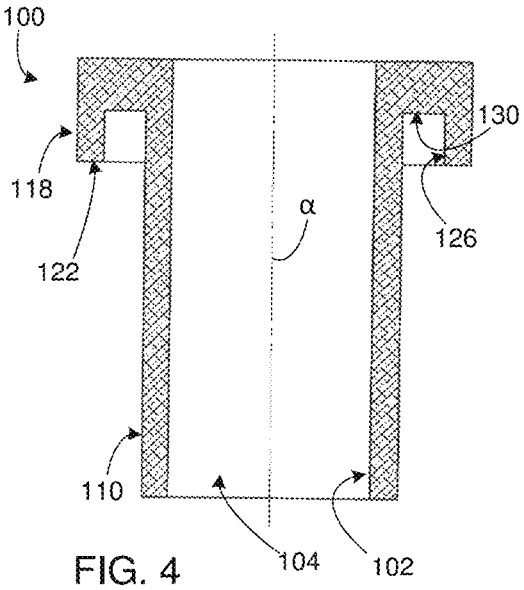
FIG. 4 is a cut-away side view illustration of the captured cylinder sleeve of FIG. 2, cut at line A-A.
Figure 5:
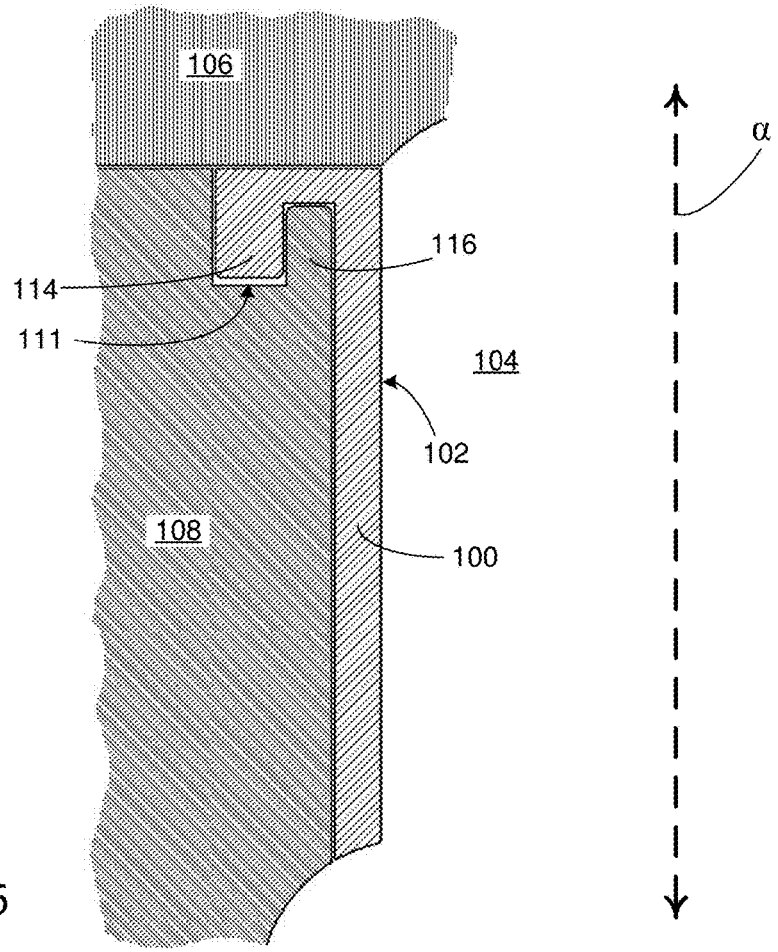
FIG. 5 is a cut-away segmental side view illustration of an alternate exemplary embodiment of the current captured cylinder sleeve seated in an engine block.
Figure 6:
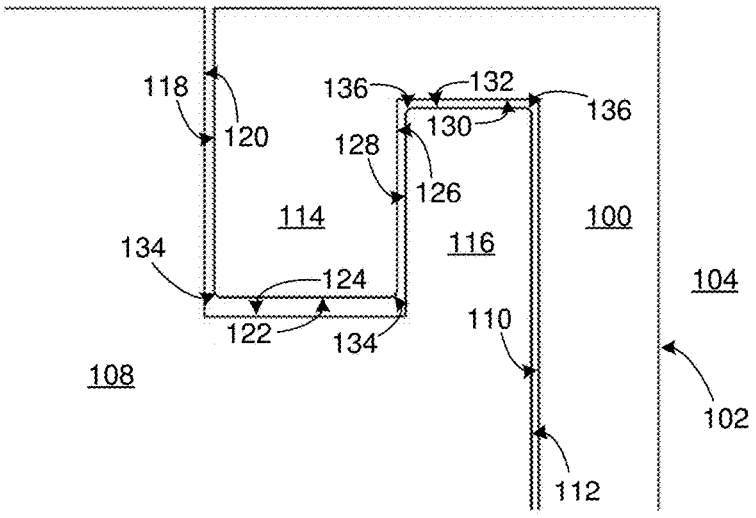
FIG. 6 is an enlarged segmental view of the cut-away segmental side view illustrated in FIG. 5.

An exemplary embodiment of the current captured cylinder sleeve 100 is shown in FIGS. 1-6. The cylinder sleeve 100 has a cylindrical shape designed to line the walls of a combustion chamber 104. The sleeve face 102 defines the outer bounds of the combustion chamber 104, and provides a smooth, durable surface upon which a piston and piston rings slide during operation of a respective engine. The cylindrical shape of the sleeve 100 creates a reference axis a around which the cylindrical features of sleeve 100 may be seen as encircling. The sleeve face 102 may be positioned to form a cylindrical surface around axis a. Cylinder sleeves are known in the field of art to possibly abut against the engine head 106. In some prior art embodiments, a portion of a cylinder sleeve may be impinged between a portion of an engine block 108 and an engine head 106. The interface gaps between the sleeve 100, head 106, and block 108 are not shown to scale, but are instead enlarged for illustration purposes. The exemplary captured sleeve 100 shown in FIG. 6 is schematically shown as a segmental close-up of FIG. 5, but the cut surfaces are not crosshatched, as in FIG. 5, in order to make the illustration visually clear.

For reference uniformity, the words "top" and "bottom" may be used in this disclosure. As used herein, these terms are in reference to the top and bottom of a piston stroke that occurs within the combustion chamber 104 of an internal combustion engine cylinder. A piston is not shown in the illustrated combustion chamber 104, but one skilled in the art would appreciate that the top of the cylinder would be near the head 106, and the bottom of the cylinder would be distal the head 106.

The exemplary captured sleeve 100 has a sleeve perimeter 110 that may be positioned to form a cylindrical surface around axis a. The sleeve face 102 and the sleeve perimeter 110 are cylindrically coaxial around axis a. The sleeve perimeter 110 is the face of sleeve 100 opposite sleeve face 102, and as such is farther away from axis a than sleeve face 102. Since the sleeve 100 is typically press-fit into the engine block 108, the sleeve perimeter 110 is intended to be in impinged contact with a sleeve bore outer face 112.

The sleeve bore outer face 112 may form a cylindrical surface around axis a, and may be the surface created when the general combustion chamber void is formed in the engine block 108, or when the original combustion chamber has been bored-out to accommodate the sleeve 100. In an engine block 108 that does not employ a cylinder sleeve, the sleeve bore outer face 112 could form the outer wall of the combustion chamber 104. In the exemplary embodiment, the block 108 has been bored-out to accommodate captured sleeve 100. In addition to boring-out the combustion chamber 104 to accommodate the thickness of the sleeve 100, a counter-bored groove 111 is cut in the top of the engine block 108. The counter-bored groove 111 is cut axial to the axis a, but farther from axis a than sleeve bore outer face 112.

The exemplary sleeve 100 has a sleeve appendage 114. The sleeve appendage 114 extends outwardly from the body of the sleeve 100 distal the sleeve face 102. In its entirety, exemplary sleeve appendage 114 may encircle axis a at a distance greater than the sleeve perimeter 110, and as such, sleeve perimeter 110 may be seen as closer to axis a than sleeve appendage 114. In the exemplary embodiment, block finger 116 is the portion of engine block 108 material remaining after counter-bored groove 111 is cut in the block 108. Block finger 106 may fit into the space between the sleeve appendage 114 and the sleeve perimeter 110.

In the exemplary embodiment, the appendage perimeter 118 is the outermost surface of the appendage 114. The exemplary innermost surface of the appendage 114 is the appendage inner face 126. In the exemplary embodiment, the appendage perimeter 118 and the appendage inner face 126 are coaxial around axis a. The exemplary surface that connects the appendage perimeter 118 and the appendage inner face 126 is the appendage leading face 122.

In the exemplary embodiment, the counter-bored groove outer face 120 is the outermost surface of the counter-bored groove 111. The exemplary innermost surface of the counter-bored groove 111 is the block finger outer face 128. In the exemplary embodiment, the counter-bored groove outer face 120 and the block finger outer face 128 are coaxial around axis a. The exemplary surface that connects the counter-bored groove outer face 120 and the block finger outer face 128 is the counter-bored groove bottom 124.

When the sleeve 100 is properly seated in block 108, appendage 114 extends into a counter-bored groove 111 in engine head 106. An exemplary block finger 116 is formed between the combustion chamber 104 and the counter-bored groove 111. Exemplary captured sleeve 100 has a reference stop 130 perpendicular to sleeve perimeter 110 and a point on axis a. Reference stop 130 is intended to abut block finger crown 132 when captured sleeve 100 is properly seated in engine block 108. The sleeve 100 and block finger 116 should be sized to form a tight abutment between reference stop 130 and block finger crown 132 when head 106 is properly secured to the block 108.

When captured sleeve 100 is properly seated in engine block 108 the sleeve perimeter 110 abuts firmly against sleeve bore outer face 112. To obtain secure press-fit interference between the captured sleeve 100 and the sleeve bore outer face 112 in the engine block 108, the sleeve perimeter 110, must be precisely, correspondingly sized to abut firmly against sleeve bore outer face 112. Additionally, the block finger 116 and counter-bored groove 111 must be precisely, correspondingly sized to accommodate the appendage 114 and the gap between the appendage inner face 126 and the sleeve perimeter 110.

In this disclosure the sleeve 100 press-fit interference is the amount that the distance between exemplary sleeve perimeter 110 and sleeve bore outer face 112. A sleeve 100 press-fit interference of between 0.0001 and 0.002 is suggested, but the precise interference fit may vary dependent upon materials and component sizes, as do conventional interference fit specs. However, the current invention enables reliable seating with less sleeve 100 interference fit, so as to be adequately press-fit under ambient temperatures. Shrink fit insertion is compatible with this process and sleeve.

In this disclosure the appendage 114 press-fit interference is the amount that the width of the appendage 114 is greater than the counter-bored groove 111. In other words, the appendage 114 press-fit interference is the amount that the distance between the counter-bored groove outer face 120 and the block finger outer face 128 is greater than the distance between the appendage perimeter 118 and the appendage inner face 126. An appendage 114 press-fit interference of between 0.0002 and 0.004 is suggested, but the precise interference fit may vary dependent upon materials and component sizes, as do conventional interference specs. However, the current invention permits reliable seating with less appendage 114 interference fit, so as to be adequately press-fit under ambient temperatures.

Exemplary appendage 114 has an exemplary appendage leading face 122, which faces the counter-bored groove bottom 124 of exemplary head counter-bored groove 111. Exemplary appendage leading edges 134 are formed at both the interface of exemplary appendage perimeter 118 and exemplary appendage leading face 122, and exemplary appendage inner face 126 and exemplary appendage leading face 122. Appendage leading edges 134 are the edges at the bottom of exemplary appendage 114.

In the exemplary embodiment, appendage leading edges 134 may be slightly rounded sufficiently to permit the smooth insertion of appendage 114 into the block counter-bored groove 111. Appendage leading edges 134 may be rounded in order to enable the press-fitting of exemplary appendage 114 into block counter-bored groove 111 when appendage 114 is sized slightly larger than block counter-bored groove 111, as is desirable to obtain a secure press-fit interference between the exemplary captured sleeve 100 and the engine block 108. A rounded edge permits the narrower appendage leading edge 134 at the start of the curve radii of the leading edges 134 to fit in between the counter-bored groove outer face 120 and the block finger outer face 128. The rounded leading edges 134 then push the edge material of the counter-bored groove outer face 120 and the block finger outer face 128 outwardly during press-fitting. A sharp leading edge to the appendage 114 would possibly shave material off the opening edge of the counter-bored groove outer face 120 and the block finger outer face 128, creating unwanted debris in the block counter-bored groove 111. A taper may be used selectively in place of rounding on appendage leading edges 134.

In the exemplary embodiment, the block counter-bored groove 111 is cut slightly deeper than required to abut the finger crown 132 against reference stop 130, creating a space between the counter-bored groove bottom 124 and the appendage leading face 122. Unwanted debris may get pushed into this space and not interfere with the proper function of the engine and its components.

Exemplary block finger 116 has a finger crown 132, which faces the reference stop 130 of the exemplary captured sleeve 100. Exemplary finger leading edges 136 are formed at both the interface of exemplary block finger outer face 128 and the finger crown 132, and sleeve bore outer face 112 and the finger crown 132. Exemplary finger leading edges 136 are the edges at the top of the finger 116.

In the exemplary embodiment, finger leading edges 136 may be slightly rounded sufficiently to permit the smooth insertion of finger 116 into the space between the appendage 114 and the sleeve perimeter 110. Finger leading edges 136 may be rounded in order to enable the press-fitting of exemplary finger 116 into the space between the appendage 114 and the sleeve perimeter 110 when finger 116 is sized slightly larger than the space between the appendage 114 and the sleeve perimeter 110, as is desirable to obtain a secure press-fit interference between the exemplary captured sleeve 100 and the engine block 108. A rounded finger leading edge 136 permits the narrower finger leading edge 136 at the start of the curve radii of the finger leading edges 136 to fit in between the appendage 114 and the sleeve perimeter 110. The rounded finger leading edges 136 then push the edge material of the appendage 114 outwardly during press-fitting. A sharp leading edge to the finger 116 would possibly shave material off the opening edge of the appendage 114, creating unwanted debris between the reference stop 130 and the finger crown 132. A taper may be used selectively in place of rounding on finger leading edges 136.

Figure 7:
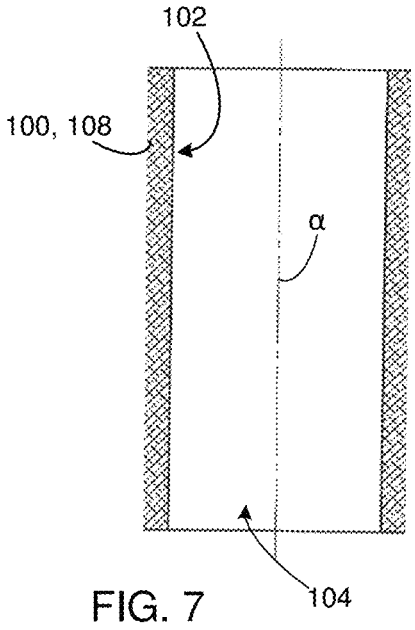
FIG. 7 is a cut-away side view of a cylinder bore prior to the present invention being formed on the cylinder wall.
Figure 8:
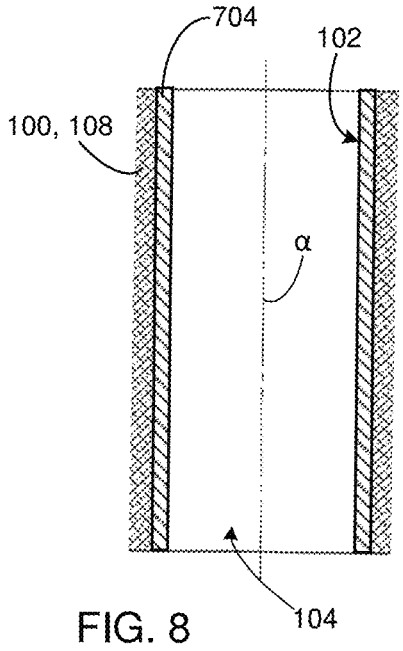
FIG. 8 a cut-away side view of a cylinder bore as in FIG. 7 with the initial layer of material formed on the cylinder wall.
Figure 9:
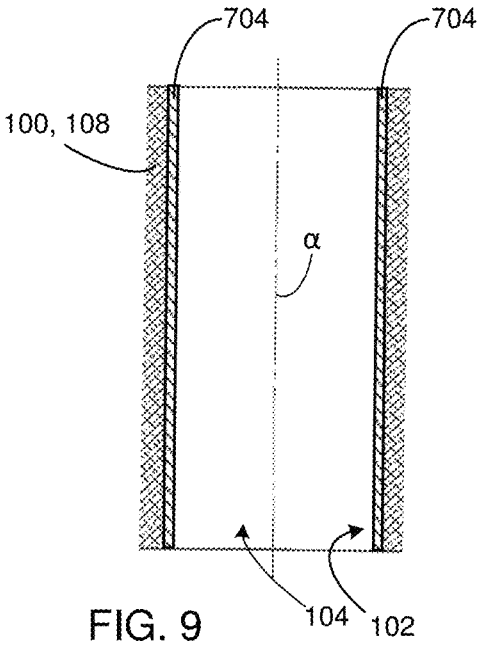
FIG. 9 a cut-away side view of a cylinder bore as in FIG. 7 with the initial layer of material thinned to form the final extreme wear coating within the outer surface of the cylinder wall.

Referring now primarily to FIGS. 7-9, an exemplary embodiment of the current extreme wear coating 704 may be formed on the sleeve face 102. In situations where the combustion chamber 104 is already lined with a sleeve, or if the engine block is comprised of a suitable metal, such as aluminum, the extreme wear coating 704 may be formed on the block 108, on a surface positioned as the sleeve bore outer face 112 in FIG. 6. The extreme wear coating 704 may become a durable coating on the sleeve face 102, or block 108, intermediate the combustion chamber 104.

The sleeve face 102 or block 108 may be initially made an oversized amount, dependent on the base material and the desired bore being ultimately sought in the extreme wear coating 704. Alternately, an existing sleeve 100 may be bored to increase the bore diameter, creating a new sleeve face 102 or block 108. In the exemplary embodiment, the bore may be made 0.004 inches larger than the desired final combustion chamber 104, otherwise referred to as the bore diameter.

In FIG. 8, an oxide coating may be formed on the sleeve face 102 or block 108 of the sleeve 100 that makes the combustion chamber 104. The oxide may be formed integral to the surface of the sleeve face 102 or block 108 and molecularly bonded to the surface of the sleeve face 102 or block 108. Several types of oxide coatings are suitable, depending on the performance characteristics desired in the exemplary extreme wear coating 704. The thickness of the coating may be grown to a size greater than the desired final thickness, because the integrity of the middle of the coating and a thicker coating is uniform and reliable. In the exemplary embodiment, the coating may be grown to a greater extent than needed, making the bore 0.006 inches smaller than the desired final combustion chamber 104, or bore diameter.

In FIG. 9, the exemplary embodiment of an extreme wear coating 704 may be formed by removing overage of the coating formed on the surface of the of the sleeve face 102 or block 108 within the combustion chamber 104 of the sleeve 100 to arrive at the final desired cylinder diameter.

Figure 10:
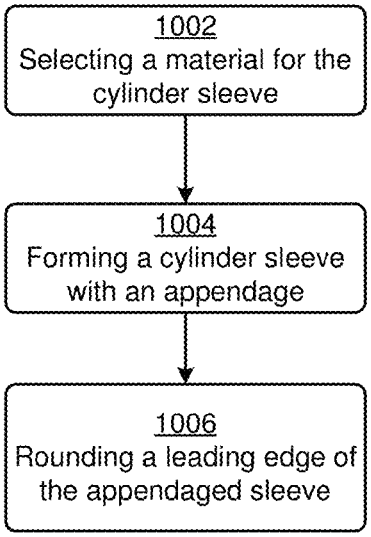
FIG. 10 is a flowchart illustrating an exemplary process for making a captured cylinder sleeve.

Referring now to FIG. 10, an exemplary general process of making an appendaged sleeve 100 is shown. The process includes selecting a desired cylinder sleeve material (1002), so that the sleeve 100 is suitable for the particular engine block 108, and has the desired physical properties. The exemplary process also includes forming a cylinder sleeve with an appendage (1004), using the chosen sleeve material, where the appendage 114 may be formed axial to the axis a, but farther from axis a than the sleeve perimeter 110. Additional features may also be formed, including an appendage perimeter 118, and appendage leading face 122, and an appendage inner face 126.

Additionally, optionally rounding or tapering a leading edge of the appendaged sleeve (1006), so that the leading edges do not shave off part of the entry perimeter of the counter-bore groove and create unwanted debris in the counter-bore groove. This rounding of the leading edges makes the sleeve more suitable for press-fit installation in ambient temperatures.

Figure 11:
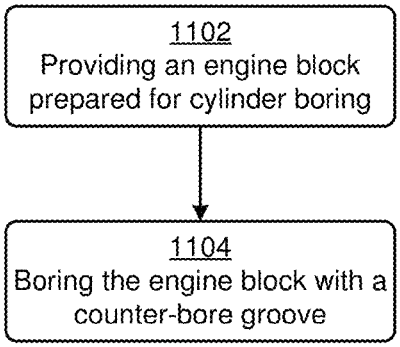
FIG. 11 is a flowchart illustrating an exemplary process for preparing an engine block for installation of a captured cylinder sleeve.

Referring now to FIG. 11, an exemplary process for making a captured sleeve 100, also referred to as an appendaged sleeve 100, because it is a sleeve comprising an appendage 114. The process includes providing an engine block prepared for cylinder boring (1102). Engine boring is known in the field, so one of ordinary skill in the art will appreciate what would be required to prepare an engine block 108 for cylinder boring. The exemplary process also includes boring the engine block with a counter-bore groove (1104), which may include both boring a typical enlarged cylinder void in the engine block 108 that forms a sleeve bore outer face 112, as well as the counter-bore groove 111, which is cut axial to the axis a, but farther from axis a than sleeve bore outer face 112.

Figure 12:
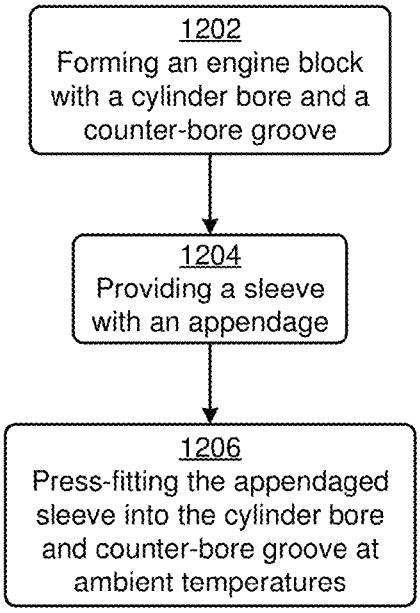
FIG. 12 is a flowchart illustrating an exemplary process for installing a captured cylinder sleeve in an engine.

Referring now to FIG. 12, an exemplary process of securely press-fitting of the appendaged sleeve into the engine block at ambient temperatures is shown. Given the advantageous function of the appendaged sleeve 100, the typical steps of heating an engine block 108 and cooling a conventional sleeve may be avoided. The appendaged sleeve 100 may be secured in engine block 108 by forming an engine block with a cylinder bore and a counter-bore groove (1202) extending into the engine block 108, where the counter-bore groove 111 may be cut axial to the axis a, but farther from axis a than sleeve bore outer face 112. Additional features may also be formed, including a counter-bored groove outer face 120, a counter-bored groove bottom 124, and a block finger outer face 128.

The exemplary process may also include providing a sleeve with an appendage (1204), where such sleeve 100 may be referred to as a captured sleeve 100 and an appendaged sleeve 100. In addition to an appendage 114, the sleeve 100 may include such features as an appendage perimeter 118, and appendage leading face 122, and an appendage inner face 126. The captured sleeve has features that are precisely sized to correspond to the particular cylinder bore.

Additionally, the exemplary process may include press-fitting an appendaged sleeve into the cylinder bore and counter-bore groove at ambient temperatures (1206), where such appendaged sleeve 100 is press-fit into the combustion chamber where the sleeve perimeter 110 interfaces in an impinged fashion against sleeve bore outer face 112, and the appendage 114 is snugly inserted into the counter-bore groove 111, such that the finger crown 132, abuts the reference stop 130. Such an interference fit may be accomplished by seating methods known in the field to squarely insert a cylinder sleeve in an engine block 108 without heat treating the engine block 108 or cold treating the sleeve 100. Engine block 108 heating and sleeve 100 cooling may still be used with sleeve 100.

The foregoing disclosure and description of the invention is illustrative and explanatory thereof. The examples contained in this specification are merely possible implementations of the current device and process, and alternatives to the particular features, elements and process steps, including scope and sequence of the steps may be changed without departing from the spirit of the invention. The present invention should only be limited by the following claims and their legal equivalents, since the provided exemplary embodiments are only examples of how the invention may be employed, and are not exhaustive.

I claim:

1. A cylinder sleeve for an engine block having an engine block material and combustion chamber, having combustion chamber, with a sleeve bore outer face, formed therein, the cylinder sleeve having a cylinder sleeve having a cylinder sleeve material with a different coefficient of expansion than the engine block material, comprising:

a sleeve body with a sleeve perimeter, a sleeve face, a sleeve axis, and a radial reference stop; the sleeve body having a sleeve appendage;

the cylinder sleeve having a properly seated position in which the sleeve perimeter is correspondingly sized to abut firmly against a sleeve bore outer face;

the sleeve appendage having an appendage perimeter, appendage leading edge, and an appendage inner face extending upwardly from the appendage leading edge;

the sleeve perimeter, the sleeve face, the appendage inner face, and the appendage perimeter coaxial to the sleeve axis;

a distance between the appendage inner face and the sleeve axis being less than a distance between the appendage perimeter and the sleeve axis; and a distance between the sleeve face and the sleeve axis being less than a distance between the appendage inner face and the sleeve axis.

2. The cylinder sleeve of claim 1, further comprising:

the sleeve appendage protruding outwardly from the sleeve body distal the sleeve face.

3. The cylinder sleeve of claim 1, further comprising:

the appendage perimeter having a leading edge, and the leading edge being rounded.

4. The cylinder sleeve of claim 1, further comprising:

the appendage inner face having a leading edge, and the leading edge being rounded.

5. The cylinder sleeve of claim 1, further comprising:

the appendage perimeter having a leading edge, and the leading edge being tapered.

6. The cylinder sleeve of claim 1, further comprising:

the appendage inner face having a leading edge, and the leading edge being tapered.

7. The cylinder sleeve of claim 1, further comprising:

the distance from the appendage perimeter to the sleeve axis being greater than the distance from the sleeve perimeter to the sleeve axis.

* * * * *